United States Patent [19]

Ahlers et al.

[11] 4,369,820

[45] Jan. 25, 1983

[54] FILLING ELEMENT FOR COUNTERPRESSURE FILLING MACHINES

[75] Inventors: Egon Ahlers, Neu-Bamberg; Alfred Rentel, Bad Kreuznach, both of Fed. Rep. of Germany

[73] Assignee: Seitz-Werke GmbH, Bad Kreuznach, Fed. Rep. of Germany

[21] Appl. No.: 240,262

[22] Filed: Mar. 4, 1981

[30] Foreign Application Priority Data

Mar. 5, 1980 [DE] Fed. Rep. of Germany ..... 3008386

[51] Int. Cl.[3] ..... B65B 31/00; B65B 3/26

[52] U.S. Cl. ..... 141/39; 141/90; 141/198; 141/286

[58] Field of Search ..... 141/6, 39, 40, 44, 47, 141/89, 90, 91, 198, 286, 301, 302, 307, 392

[56] References Cited

U.S. PATENT DOCUMENTS 3,633,635 1/1972 Kaiser ..... 141/40

FOREIGN PATENT DOCUMENTS 1217814 8/1961 Fed. Rep. of Germany .

*Primary Examiner*—Frederick R. Schmidt

*Attorney, Agent, or Firm*—Becker & Becker, Inc.

[57] ABSTRACT

A filling element, for single- and multi-chamber counterpressure-filling machines, with a filling tube held in a filling element body for introducing liquid into a container pressed into engagement against a container sealing region on the lower part of the filling element body; the filling tube extends through the container sealing region and is surrounded by an annular gap-like hollow chamber. A pressurized gas system is provided and has a pressurized gas valve arrangement controlled by devices installed on the filling machine, and conduits opening into the annular gap-like hollow chamber for introduction and discharge of pressurized gas. Also provided is a liquid flow valve, controlled at least for closing, and a control element arranged on the filling tube and responding at a predetermined filling height or level of the liquid in the container for terminating the inflow of liquid thereto. The hollow chamber surrounding the filling tube is embodied as an annular pressurized gas chamber with a cross section which is substantially enlarged toward the interior thereof compared with the annular gap-like outlet arranged in the region of the container sealing region. This annular pressurized gas chamber is delimited laterally by essentially cylindrical surfaces, and at least one pressurized gas outlet conduit opens into the lower end region of the pressurized gas chamber. At least one pressurized gas inlet conduit, located in the same plane or in a plane thereabove, opens essentially tangentially of the cylindrical delimiting surfaces into the pressurized gas chamber.

12 Claims, 6 Drawing Figures

FILLING ELEMENT FOR COUNTERPRESSURE FILLING MACHINES

The present invention relates to a filling element, for single- and multi-chamber counterpressure filling machines, including the following components:

(a) a filling tube held in a filling element body for introducing liquid into a container pressed into engagement at a container sealing region on the lower part of the filling element body, with the filling tube extending through the container sealing region and being surrounded by an annular gap-like hollow chamber;

(b) a pressurized gas system, with a pressurized gas valve arrangement controlled by devices installed on the filling machine, and with conduits, for introducing and discharging pressurized gas, which open into the annular gap-like hollow chamber;

(c) a liquid flow valve, controlled at least for closing; and (d) a control element arranged at the filling tube and responding at a predetermined filling level of the liquid in the container for terminating the inflow of liquid thereto.

U.S. Pat. No. 3,633,635 Kaiser issued Jan. 11, 1972, belonging to the assignee of the present invention, discloses filling elements of the abovementioned type. The narrow, annular gap-like hollow chamber, formed between the filling tube, the filling tube mounting or support, an intermediate piece, and the centering tulip for the container to be pressed-on, is at its upper end in connection with a pressurized gas tube by way of upwardly directed inclined bores, and at a small distance below the mouth or opening of these bores is in connection with an essentially radially directed bore. From this bore a throttle path branches off leading into the atmosphere. However, this annular gap which is open with full cross section to the pressed-on container, and which conveys the pressurized gas, the return gas, and the relief gas, has the drawback that, for example during the relieving of a filled container, foam and liquid rise therein; and at the beginning of the pressurizing of a subsequently to be filled container, such foam and liquid is blown into this container and is atomized into finest particles and deposited in such particle form on the container walls. If the $CO_2$-containing liquid flowing into the container through the filling tube after pressurizing comes into contact with the liquid particles deposited on the container wall, carbon dioxide is spontaneously set free at these particles, and consequently a considerable disquieting occurs in the liquid so that, particularly in the interest of maintaining the required filling height in the containers, the filling machine can be operated only with considerably reduced throughput.

German Auslegeschrift No. 12 17 814 discloses a filling element with which the filling tube in its support or mounting is surrounded by an annular gap which is connected at its upper end with one or two pressurized gas conduits by a bore or bores extending essentially parallel to the filling tube. A gas relief or outlet valve is connected to this annular gap by an approximately centrally arranged radial bore. Also this previously known apparatus has the aforementioned disadvantages and drawbacks which are caused by the liquid residue remaining in the annular gap after a filling process in connection with the pressurizing.

It is an object of the present invention, with a filling element having a filling tube in a filling element body, to make it much more difficult for the foam and liquid to rise in the annular hollow chamber formed around the filling tube above the region for pressing-on the container, and to eliminate any foam and liquid, which may nevertheless have penetrated into this annular hollow chamber during the subsequent pressurizing, in such a way that no portions of these foam and liquid residues, which would impair the quiet rise of the liquid in the container to be filled, can pass into the container.

This object, and other objects and advantages of the present invention, will appear more clearly from the following specification in connection with the accompanying drawings, in which.

Figure 1:
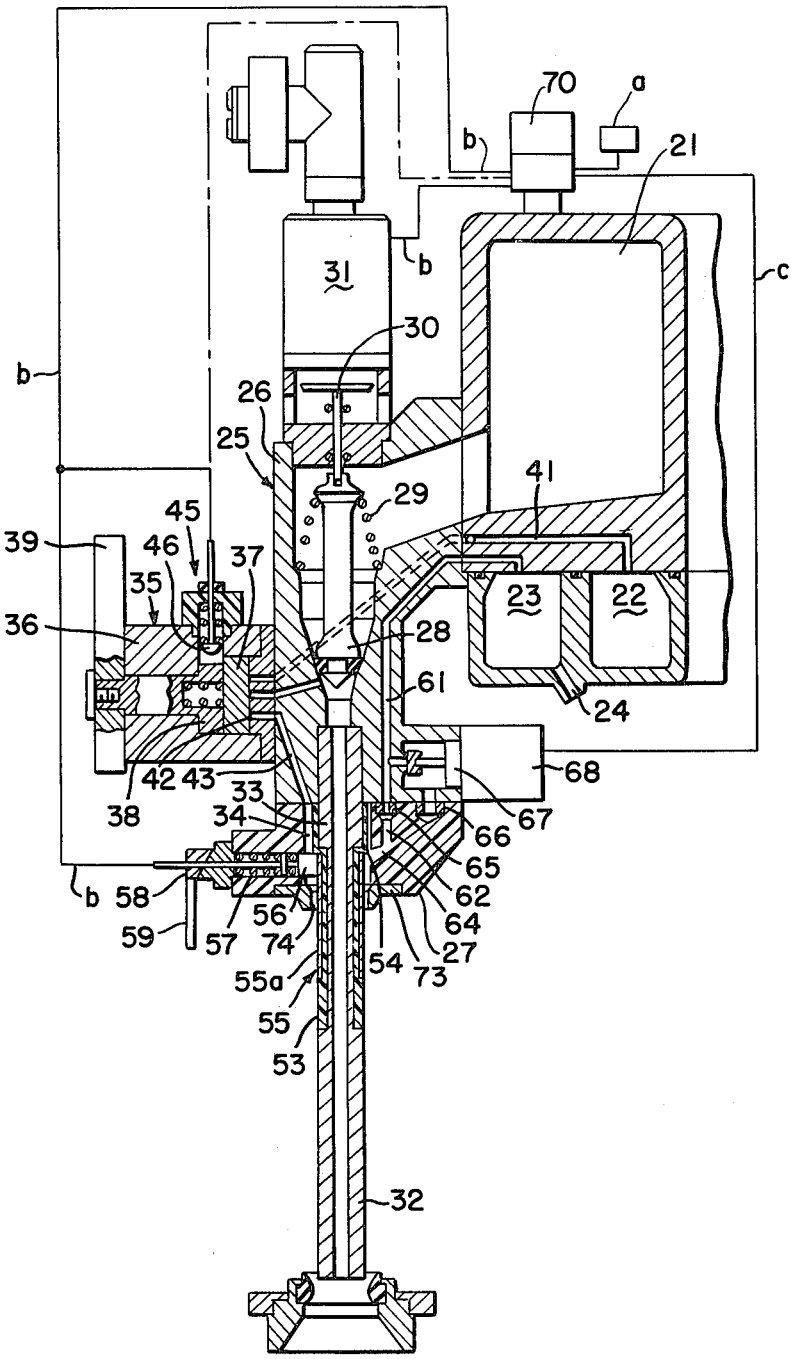
FIG. 1 illustrates an axial section in rest position of a filling element having features in accordance with the present invention for a multi-chamber embodiment.
Figure 2:
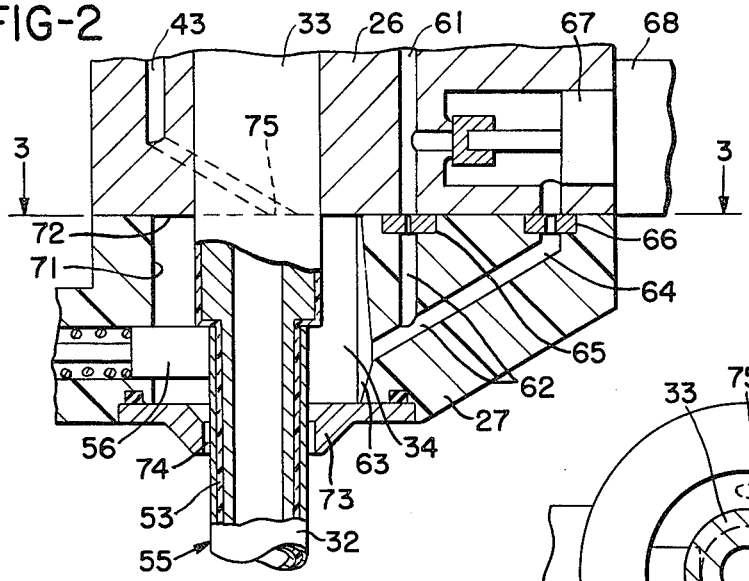
FIG. 2 shows an enlarged illustration of the pressurized gas chamber.
Figure 3:
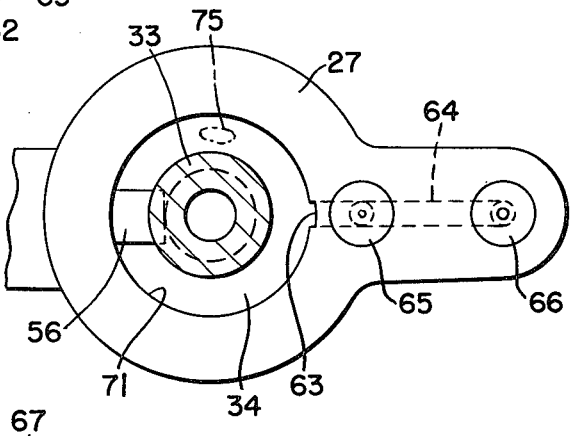
FIG. 3 is a section taken along line 3—3 in FIG. 2.

The filling element of the present invention is characterized primarily in that the hollow chamber surrounding the filling tube is embodied as an annular pressurized gas chamber with a cross section which is substantially enlarged toward the interior thereof compared with the annular gap-like outlet arranged in the region of the container sealing region. This annular pressurized gas chamber is delimited laterally by essentially cylindrical surfaces, while into the lower end region of this pressurized gas chamber there opens at least one pressurized gas outlet conduit and, in the same plane or in a plane located thereabove, there opens at least one pressurized gas inlet conduit, essentially tangentially to the cylindrical delimiting surfaces, into the pressurized gas chamber. This annular pressurized gas chamber with essentially cylindrical embodiment and an essentially enlarged cross section in its inner region relative to the restricted gap-like outlet, in connection with the tangential introduction of the pressurized gas into the pressurized gas chamber, and discharge of the pressurized gas in the lower end region of the pressurized gas chamber, offers an effective rinsing of the pressurized gas chamber at the beginning of the introduction of the pressurized gas when the container to be filled is pressed-on, whereby foam and liquid residues contained in the pressurized gas chamber are effectively eliminated by way of the outlet conduit. The narrow gap-like outlet of the pressurized gas chamber in the region of the pressing-on and sealing of the container to be filled brings about that no quantities of foam and liquid residues worth mentioning can pass into the container to be filled. Additionally, the narrowed or restricted cross section at the outlet of the pressurized gas chamber brings about that the entry of foam and liquid into the pressurized gas chamber is much more difficult.

An effective removal of liquid and foam residue by way of the pressurized gas outlet conduit can be essentially improved thereby that in the outer peripheral surface of the annular pressurized gas chamber, in the region of the mouth or opening of the pressurized gas outlet conduit, there is provided a gas-guidance groove which extends essentially axially relative to the pressurized gas chamber. This gas-guidance groove can extend upwardly and downwardly from the mouth of the pressurized gas outlet conduit. The upwardly extending part of the gas-guidance groove, however, is particularly effective. For the purpose of attaining an optimum collecting and removal of the foam and liquid residue under the least possible disturbance of the pressurized gas whirl generated in the pressurized gas chamber by the tangential introduction of the pressurized gas, the gas guidance groove can be embodied tapered upwardly and suitably also downwardly from the mouth of the pressurized gas outlet conduit.

Another especially effective possibility for collecting as well as removing the foam and liquid residue from the pressurized gas whirl generated in the pressurized gas chamber comprises forming a gas-guidance rib, which extends essentially helically, along the outer peripheral surface of the annular pressurizing gas chamber in the region of the mouth of the pressurizing gas outlet conduit. Foam and liquid particles carried along in the pressurized gas whirl deposit on, or strike this gas-guidance rib and from there are guided to the pressurized gas outlet conduit. This effect is brought about in an optimum manner in that the gas-guidance rib is guided helically downwardly past a location behind the mouth of the pressurized gas outlet conduit in the circulating direction of the pressurized gas whirl generated in the pressurized gas chamber by the tangentially directed mouth of the pressurized gas inlet conduit. The gas-guidance rib can be embodied with a rear flat or horizontal flank or side, as well as with a steep flank or side directed opposite to the circulating direction of the pressurized gas whirl generated in the pressurized gas chamber by the tangentially directed mouth of the pressurized gas inlet conduit. The gas-guidance rib can be guided with its steep flank closely past the mouth of the pressurized gas outlet conduit.

To assure that the desired rinsing process in the pressurized gas chamber occurs at the beginning of the feeding of the pressurizing gas, and that during this feeding possibly no foam and liquid particles pass into the pressed-on container, there can be provided in the pressurized gas outlet conduit a pressurized gas outlet valve which, at the beginning of the feeding of the pressurized gas, and with pressed-on container, is briefly controllable in the opened position, and which leads into the atmosphere. In this way, it is achieved that pressurized gas possibly charged with liquid and foam particles, is at the beginning of the feeding of the pressurized gas, blown practically completely into the environment, for which purpose only a short time is sufficient. However, for this purpose, a special control is necessary at the pressurized gas outlet valve.

However, there has also been found that the pressurized gas discharge leading into the environment by way of a narrow nozzle, as known from U.S. Pat. No. 3,633,635, is sufficient to remove the foam and liquid particles rinsed from the pressurized gas chamber by the pressurized gas whirl, even though this known pressurized gas discharge, leading into the environment by way of a nozzle, was only intended for permitting an only slow introduction and rinsing of the liquid in the pressed-on container at the beginning of the liquid supply or feeding thereto. A pressurized gas outlet valve arranged in a branch-conduit of the pressurized gas outlet conduit can then be used for other functions necessary during the filling process. In other words, the pressurized gas outlet conduit may be continuously open to the environment by way of a narrow nozzle, and simultaneously may have a branch conduit with an essentially larger effective through-passage cross section, with the branch conduit containing a pressurized gas outlet valve which is controllable in the opened position and leads to the atmosphere.

The features of the present invention are advantageously applicable with mechanically controlled filling elements and also with filling elements having electrical closing control for the liquid flow valve. If a filling element is equipped with a switching member or control element generating an electrical closing-control signal for the liquid flow valve, it is recommended that the switching member be embodied as an electrical conductor which is provided on the outer surface of the filling tube and is electrically insulated relative to the filling tube and the filling element body, and extends as far as into the annular pressurized gas chamber, whereby parts for the electrical connection of the switching member can be arranged in the interior of the annular pressurized gas chamber. For example, the electrical connection for the switching member can include a contact pin which is electrically insulated relative to the filling element body, and which extends essentially radially through the annular pressurized gas chamber and is resiliently pressed against the switching member at the filling tube.

Referring now to the drawings in detail, the illustrated examples show a filling element for multi-chamber counterpressure bottle filling machines. Such filling elements of circulating filling machines, which are not illustrated in greater detail, are installed on a ring-shaped or annular liquid chamber 21, the underside of which is provided with an annular pressurized gas channel 22 as well as an annular venting channel 23 having continuously open outlets 24 leading into the environment. The filling element has a filling element body 25 with a valve housing 26 and a pressurized gas chamber housing 27 made of electrically insulating synthetic material. A vertical liquid flow valve 28, which is under the influence of an opening spring 29, is located in the interior of the valve housing 26. An electromagnetic actuating device 31 acts by means of a plunger or push-rod 30 on the valve body of the liquid flow valve 28, which body is supported upon a valve seat in the housing 26. When switched on, this actuating device 31 presses the valve body onto the valve seat against the effect of the opening spring 29, consequently establishing the closed position of the liquid flow valve 28.

A filling tube 32 having a filling tube head 33 is inserted from below at the underside of the valve housing 26. The filling tube 32 extends through the pressurized gas chamber housing 27 and the region formed thereon for pressing on or sealing the container to be filled. A narrow annular gap or clearance 74 is formed between the region for pressing-on or sealing the container to be filled, and the filling tube 32; this annular gap 74 represents the outlet for the pressurized gas chamber 34 which surrounds the filling tube 32 and is formed above the gap 74 in the pressurized gas chamber housing 27. This annular pressurized gas chamber 34 has a cross section which is much larger than that of the annular gap 74.

A pressurized gas valve arrangement 35 is attached laterally to the valve housing 26 as a part of the pressurized gas system. A valve disc 37 in the form of a control disc, and rotatable by means of a carrier or support 38, is arranged in the housing 36 of the pressurized gas valve arrangement 35. At its free end projecting from the housing 36, the support 38 has an actuating lever 39. This lever 39 cooperates during machine circulation with control elements, for example control curves or control cams, installed on the frame of the filling machine at spaced intervals and in different planes, for pivoting the valve disc 37 into the particular desired operating position.

An electrical control switch 45 is additionally installed in the housing 36 of the pressurized gas valve arrangement 35. The feeler or sensor 46 of this switch 45 engages the peripheral surface, of the valve disc 37 or of the valve disc support 38, embodied as a control cam, and in this way establishes switch positions of the control switch 45 which depend on the position of the valve disc 37.

A switching member or control mechanism 55 for control of the liquid flow valve 28 is formed by having an electrically insulating layer or coating 53 applied on the outside of the filling tube 32, which is made of an electrically conductive material particularly metal. The layer 53 extends from the middle part of the actual filling-tube section upwardly to that part of the filling tube head 33 to be inserted into the valve housing 26. The electrically-insulating layer 53 extends farther over a downwardly directed shoulder 54 formed between the actual filling tube section and the filling tube head 33, the shoulder 54 being arranged inside the pressurized gas chamber 34 (FIG. 1). An annular electrical conductor 55*a* is applied to or placed on the electrically insulating coating 53, preferably in the form of a thin pressed-on precious metal sheet, for example a gold sheet or metal sheet provided with a gold coating. This electrical conductor 55*a* extends from the shoulder 54 along the outer peripheral surface of the filling tube 32 downwardly out of the pressurized gas chamber 34 as far as to below a level which corresponds to the desired filling level of the container.

The electrical connection of the switching member 55 occurs by way of a contact pin 56, which extends radially through the pressurized gas chamber 34 and is inserted into the electrically insulating pressurized gas chamber housing 27. The contact pin 56 is pressed against the electrical conductor 55*a* by means of a spring 57 and thereby simultaneously engages below the shoulder 54, thus securing the filling tube 32 in its position in the valve housing 26. A rotating wedge 58 with a pivot lever 59 is installed upon the outwardly projecting end of the contact pin 56 for the purpose of lifting the contact pin 56 off the electrical conductor 55*a* and retracting it out of the region of the shoulder 54. The rotating wedge 58 runs on a corresponding counter rotating wedge arranged on the pressurized gas chamber housing 27.

The valve housing 26 is furthermore provided with a venting conduit 61 which leads to the annular venting channel 23 located at the underside of the annular liquid chamber 21. The pressurized gas chamber 34 is connected to the venting conduit 61 by way of a discharge or outlet conduit 62 starting in the chamber housing 27 at the lower end region of the annular pressurized gas chamber 34. The outlet conduit 62 is always in open connection with the venting conduit 61 by way of a narrow nozzle 65. A branch passage or conduit 64 connected to the outlet conduit 62 below the nozzle 65 leads by way of a nozzle 66 into a valve chamber, which is in communication with the venting conduit 61; this is the valve chamber of a gas discharge or outlet valve 67 which opens and closes the connection and which is provided with an electromagnetic actuating device 68.

Of the aforementioned electrical elements, the control member 55 and the electromagnetic actuating device 31 of the liquid flow valve 28 are connected with each other via a circuit through interposition of an electrical control device 70. This circuit, which is closable by liquid contact, is formed, beginning from the control member 55 and the contact pin 56 connected therewith by a line b, which with interposed control device 70 and connected current source a leads to the electromagnetic actuating device 31; by the liquid chamber 21; by the valve housing 26 of the filling body element 25; and by the filling tube 32. The control switch 45 is connected in parallel to this circuit in the line b. The control device 70 connected to the current source a for supplying current to the circuits has electrical switching means for controlling the actuating device 31 for the liquid flow valve 28 and, as indicated in FIG. 1, can be arranged on the upper end or in the open space of the inner periphery of the annular liquid chamber 21. The gas outlet valve 67, with its electromagnetic actuating device 68, is connected by way of a line c to further control devices installed in the control device 70.

As more clearly apparent from FIGS. 2 through 5, the pressurized gas chamber 34 is delimited by an outer essentially cylindrical peripheral surface 71 which is formed in the interior of the pressurized gas chamber housing 27. The pressurized gas chamber 34 is delimited at its top by the lower end surface 72 of the valve housing 26, and at its bottom by a sealing plate 73 onto which the containers to be filled are pressed. The inner delimiting surface of the pressurized gas chamber 34 is formed by the essentially cylindrical peripheral surface of the filling tube 32 or of the electrical conductor 55*a* placed thereon, and by that of the filling tube head 33 or of the electrically insulating coating 53 placed thereon. The sealing plate 73 reaches with its middle region close to the surface of the filling tube 32 or of the electrical conductor 55*a*, and forms with the filling tube 32 only a narrow annular gap 74 which is sufficient to allow the pressurized gas during pressurization to flow from the pressurized gas chamber 34 into the pressed-on container, and during filling of the container to allow the pressurized gas to return from the container into the pressurized gas chamber 34. The flow resistance of the returning pressurized gas is to be determined in essence by the nozzle 65.

For a better clarification of the essentially schematic illustration of FIG. 1, there is set forth more clearly in FIGS. 2, 3, 4 and 5 that a pressurized gas inlet conduit 43 is arranged in the valve housing 26 in such a way that it opens into the pressurized gas chamber 34 at 75 at the lower end surface of the valve housing 26 approximately tangentially to the inner wall surface 72 above the start of the pressurized gas outlet conduit 62. For a better understanding, FIGS. 2 and 4 therefore show the filling tube head 33 with its upper part broken away.

By the essentially tangential arrangement of the opening 75 of the pressurized gas inlet conduit 43, the gas introduced under pressure is guided in a rotational motion around the filling-tube head 33 and the upper part of the actual filling tube 32 in a circulatory gas flow or whirl. This pressurized gas flow is partially discharged into the atmosphere by way of the pressurized gas outlet conduit 62 and the nozzle 65. With opened pressurized gas outlet valve 67, the pressurized gas flow can also be discharged into the atmosphere by way of the branch conduit 64, the nozzle 66, and the pressurized gas outlet valve 67.

To facilitate and improve the collection and discharge of foam and liquid particles which may pass into the pressurized gas chamber 34 through the annular gap 74, an essentially axially extending gas-guidance groove 63 is provided in the outer peripheral wall 71 of the pressurized gas chamber 34 in the region of the inlet of the pressurized gas outlet conduit 62. In the illustrated example, this gas-guidance groove 63 has an upper part which, above the inlet of the pressurized gas outlet conduit 62, tapers up to the lower end face of the valve housing 26, and has a lower part which, below the inlet of the pressurized gas outlet conduit 62, tapers downwardly to the upper surface of the sealing plate 73.

Figure 4:
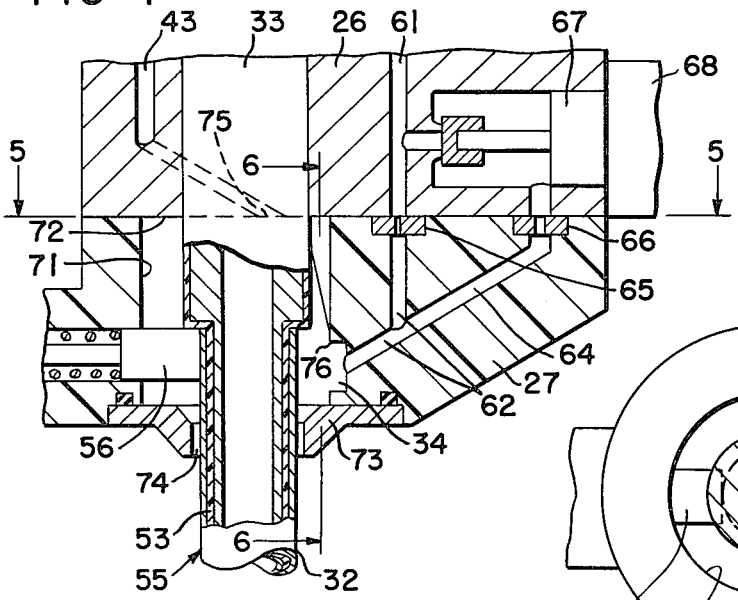
FIG. 4 is a fragmentary illustration of a modified embodiment similar to that of FIG. 2.
Figure 5:
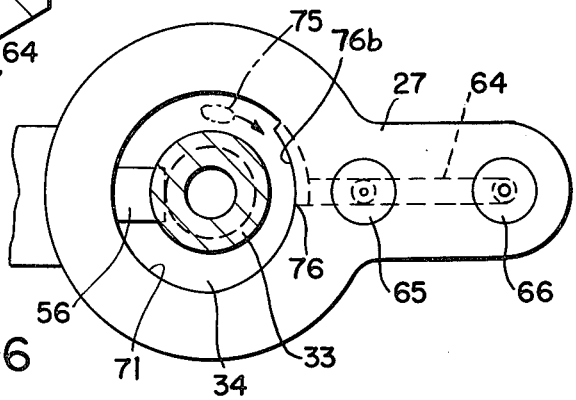
FIG. 5 is a section taken along line 5—5 in FIG. 4.
Figure 6:
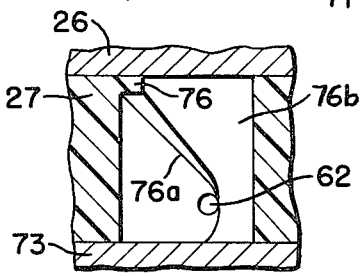
FIG. 6 is a fragmentary view along line 6—6 in FIG. 4.

The construction of the pressurized gas chamber 34 and of the pressurized gas chamber housing 27 is basically the same in the example of FIGS. 4, 5 and 6. However, in place of the gas-guidance groove 63 in the surface of the peripheral wall 71, there is provided a gas-guidance rib 76 projecting from the surface of the peripheral wall 71 to the interior of the pressurized gas chamber 34. In the illustrated example, this gas-guidance rib 76 is helically or spirally guided in the same direction of rotation as the pressurized gas whirl generated by the tangential introduction at 75 into the pressurized gas chamber 34. FIGS. 4, 5 and 6 furthermore show that the gas-guidance rib 76 has a steep and suitably even radially extending flank 76*a*. This steep flank 76*a* opposes or is counter to the flow direction of the pressurized gas whirl indicated by the arrow in FIG. 5, while the flank 76*b* of the gas-guidance rib 76, which is located rearwardly with respect to the flow direction of the pressurized gas whirl indicated by the arrow, extends in a substantially horizontally or flat manner. The gas-guidance rib 76 is so arranged that it extends with its steep flank 76*a* directly behind the inlet of the pressurized gas outlet conduit 62 in the direction of flow in the pressurized gas whirl. Due to the whirl formed in the interior of the pressurized gas chamber 34, foam particles and liquid particles, possibly present at this location, are thrown into the outer region of the whirl, i.e. into the vicinity of the peripheral wall 71, and thereby impact on the steep flank 76*a* of the gas-guidance rib 76, from where the particles are then guided into the inlet of the gas outlet conduit 62 under the influence of the gas flow passing over this steep flank 76*a*. An increase of this effect is furthermore attainable if the gas-guidance rib 76, below the inlet of the pressurized gas outlet conduit 62, is embodied in an oppositely spiral or helical configuration as indicated in FIG. 6.

The operation of the filling element in the illustrated embodiment is as follows:

The liquid valve 28 is closed in the rest position, and the pressurized gas valve arrangement 35 is likewise closed for the three passages guided by this valve arrangement 35, namely the pressurized gas supply conduit 41, the equalizing conduit 42, and the pressurized gas inlet conduit 43. The gas outlet valve 67 is likewise closed.

The filling element illustrated in FIG. 1, due to the rotational movement of the filling or bottling machine, comes into the range of a control element installed on the machine frame, for the actuating lever 39. In this way, the pressurized gas valve arrangement 35 is brought into pressurizing position, which means the operating position, in which a container to be filled is pressed from below against the filling element by means of a lifting element, and the valve disc 37 is adjusted into a position in which the pressurized gas supply conduit 41 is connected with the pressurized gas inlet conduit 43. Simultaneously, the control switch 45 has been actuated for turning on the actuating device 31 of the liquid flow valve 28. Now the pressurized gas flows at 75 into the upper part of the pressurized gas chamber 34 and forms a whirl flow circulating around the filling tube head 33 and the upper part of the filling tube 32; this whirl flow throws the foam and liquid particles, which may be present in the interior of the pressurized gas chamber 34, in the direction toward the outer peripheral wall 71 of the pressurized gas chamber 34. Consequently, such foam and liquid particles are trapped at the gas-guidance groove 63 or at the gas-guidance rib 76.

Surprisingly, it has been found that, also with the gas outlet valve 67 still closed in this operating stage, the pressurized-gas quantity flowing through the nozzle 65 in the gas outlet conduit 62 to the venting conduit 61 is sufficient to carry off the foam and liquid particles which have passed into the pressurized gas chamber 34, and thus to prevent such particles from passing into the container to be filled. In this way there occurs an effective rinsing of the pressurized gas chamber 34 to effectively remove all remaining foam and liquid particles which are still present. This is attributable to the cooperation of the circulating pressurized gas whirl, formed in the upper part of the pressurized gas chamber 34 and circulating around the filling tube head 33 and the upper part of the filling tube 32, with the narrow embodiment of the annular gap 74 at the lower outlet of the pressurized gas chamber 34 and the gas-guidance groove 63 or the gas-guidance rib 76.

When special requirements are to be met, particularly when liquids are to be bottled which tend more strongly to penetrate into the pressurized gas chamber as foam or liquid remainders and also tend more strongly to settle therein, in a special embodiment of the present invention, the pressurized gas valve arrangement 35 or the control device 70 can be embodied for briefly opening the gas outlet valve 67 to the pressurized gas chamber 34 at the start of feeding the pressurized gas. The gas discharge into the environment established by the nozzle 66 and considerably enlarged, then creates a stronger pressurized gas whirl in the pressurized gas chamber 34 as well as an essentially increased pressurized gas flow in the gas outlet conduit 62 and in the branch conduit 64. Such a stronger rinsing procedure, however, is only to be carried out for a short time. The actuating device 68 of the gas outlet valve 67 is then reversed or changed over by a time switch included in the control device 70 so that, after completion of such a brief stronger rinsing process, the normal feeding of the pressurized gas into the pressed-on container can begin until the desired pressurizing is reached.

During further circulation of the filling machine, the filling element comes into the range of a further control element on the machine frame which pivots the control lever 39 and the valve disc 37 back into the rest position. In this filling position with terminated connection between the conduits 41 and 43, as well as interrupted electrical circuit at the control switch 45, the energization of the electromagnet in the actuating device 31 is terminated, so that the opening spring 29 lifts the valve body of the liquid flow valve 28 off the valve seat, and the liquid flows through the filling tube 32 into the container to be filled. The gas displaced by the incoming liquid flows through the outlet conduit 62, the nozzle 65, and the venting conduit 61 into the annular venting channel 23, and from there through the outlets 24 into the atmosphere. A time delay member included in the control unit 70 is actuated together with the interruption of the electrical circuit at the switch 45; after passage of a previously determined time, this time delay member reverses or changes over the actuating device 68 of the gas outlet valve 67, so that now the gas outlet valve 67 is opened and the pressurized gas displaced by the entering liquid can flow to the outside by way of the nozzle 66 and the gas outlet valve 67. The nozzle 66 is so dimensioned that it will let sufficient pressurized gas escape in order to permit a relatively quick filling of the container. However, the nozzle 66 is still sufficiently narrow to maintain sufficient pressure in the interior of the container to be filled in order to equalize the liquid pressure on the liquid flow valve 28, and to hold the liquid flow valve 28 securely open under the influence of the opening spring 29. Simultaneously, the nozzle 66 is also so dimensioned that, during the rinsing process previously described, it will permit a sufficiently quick discharge of the pressurized gas to the outside to assure an effective rinsing of the pressurized gas chamber 34, and also to avoid the overflow of pressurized gas into the container during the rinsing process.

The filling process lasts until the level of the liquid has reached the switch member 55. Since the liquid is electrically conductive, it establishes the contact with the switch member 55, so that by the electrical circuit produced through the liquid contact a closing-control signal is transmitted to the control device 70. The closing-control signal influences the switching means of the control device 70 in such a manner that the electromagnet of the actuating device 31 is energized, and the liquid flow valve 28 enters into its closed position. The valve disc 37 (FIG. 1) is pivoted into equalizing position during further circulation of the filling element and renewed contact of the actuating lever 39 with a further control element. In this position, the contacts on the control switch 45 are open and a connection is established between the pressurized gas inlet conduit 43 and the equalizing conduit 42. As a result, the levels of the liquid in the filling tube interior and in the filled container can adapt to or equalize with respect to each other. Simultaneously the overpressure, which still exists in the gas space of the container and in the system components which are in communication with this gas space in the container by way of the conduits 42 and 43, is relieved by way of the conduit 62, the nozzle 65, the conduit 61 and the annular venting channel 23. In this operating position, in which the parallel electrical circuit at the control switch 45 is open, the electrical circuit established by the liquid contact at the control member 55 remains closed and holds the liquid flow valve 28 in the closed position.

During further circulation of the filling element, the bottle or container is removed by being lowered from the filling element. As a result, the electrical circuit established by the liquid contact is interrupted, so that the electromagnet of the actuating device 31 is de-energized. The closed position of the liquid flow valve 28 is now maintained by the effective pressure of the liquid in the liquid chamber 21. The valve disc 37 in turn can be pivoted back into the rest position by renewed approach on or contact with a control element on the machine frame.

With embodiments of filling elements, the filling tubes of which, for example, are held without a filling tube head 33, the arrangement of pressurized gas inlet conduit 43 and pressurized gas outlet conduits 62, 64 can be made in such a manner that the pressurized gas inlet conduit 43 opens into the pressurized gas chamber 34 in the plane of the opening of the pressurized gas outlet conduits 62, 64 located in the lower end region, whereby the height of the pressurized gas chamber 34 is reduced. Also, the shape of the pressurized gas chamber 34 is not limited to a cylindrical embodiment; it can, for example, also be conically embodied.

The present invention is, of course, in no way restricted to the specific disclosure of the specification and drawings, but also encompasses any modifications within the scope of the appended claims.

What we claim is:

1. A filling element, for single- and multi-chamber counterpressure filling machines, for introducing liquid into a container, said filling element comprising:

a filling element body having a container-sealing region at a first end thereof;

a filling tube held in said filling element body for introducing liquid into a container pressed into engagement at said container-sealing region, said filling tube extending through said container-sealing region into said filling element body, and being surrounded by an annular pressurized gas chamber provided in said filling element body and having an annular gap-like outlet arranged in the region of said container-sealing region, and a cross section which is substantially greater toward the interior thereof than is that of said annular gap-like outlet, said annular pressurized gas chamber being delimited laterally by essentially cylindrical surfaces;

a pressurized gas system, including a pressurized gas valve arrangement controlled by devices installed on said filling machine, and conduits, for introducing and discharging pressurized gas, which open into said pressurized gas chamber, said conduits including at least one pressurized gas outlet conduit opening into the lower end region of said pressurized gas chamber, and at least one pressurized gas inlet conduit which opens into said pressurized gas chamber no lower than the plane of the opening of said at least one pressurized gas outlet conduit, said at least one pressurized gas inlet conduit opening essentially tangentially relative to said cylindrical delimiting surfaces;

a liquid flow valve arranged in said filling element body and operatively associated with said filling tube, said liquid flow valve being controlled at least for closing; and a control element associated with said filling tube and responding at a predetermined filling level of said liquid in the container for terminating inflow of said liquid thereto.

2. A filling element according to claim 1, in which the outer peripheral surface of said annular pressurized gas chamber, in the region of the opening of said pressurized gas outlet conduit is provided with a gas-guidance groove which extends essentially axially relative to said pressurized gas chamber.

3. A filling element according to claim 2, in which said gas-guidance groove is provided above the opening of said pressurized gas outlet conduit and extends upwardly therefrom.

4. A filling element according to claim 2, in which said gas-guidance groove tapers outwardly from the opening of said pressurized gas outlet conduit.

5. A filling element according to claim 1, which includes an essentially helically extending gas-guidance rib in the outer peripheral surface of said annular pressurized gas chamber in the region of the opening of said pressurized gas outlet conduit.

6. A filling element according to claim 5, in which said gas-guidance rib is guided helically downwardly behind the opening of said pressurized gas outlet conduit when viewed in the circulating direction of a pressurized gas whirl generated in said pressurized gas chamber by said tangentially directed opening of said pressurized gas inlet conduit.

7. A filling element according to claim 6, in which said gas-guidance rib includes a rear horizontal flank, and a steep flank directed opposite to the circulating direction of a pressurized gas whirl generated in said pressurized gas chamber by said tangentially directed opening of said pressurized gas inlet conduit.

8. A filling element according to claim 7, in which said steep flank of said gas-guidance rib is guided closely past said opening of said pressurized gas outlet conduit.

9. A filling element according to claim 1, which includes a pressurized gas outlet valve in said pressurized gas outlet conduit, said pressurized gas outlet valve leading into the atmosphere and being briefly controllable in the opened position at the beginning of the feeding of pressurized gas with a pressed-on container.

10. A filling element according to claim 1, in which said at least one pressurized gas outlet conduit includes a pressurized gas outlet conduit which opens into said pressurized gas chamber and is provided with a narrow nozzle, said pressurized gas outlet conduit being continuously open to the atmosphere by means of said narrow nozzle, and simultaneously includes a branch conduit having an essentially larger effective through-passage cross section, said branch conduit being provided with a pressurized gas outlet valve which leads to the atmosphere and is controllable in the opened position.

11. A filling element according to claim 1, in which said control element is a switching member which generates an electrical closing-control signal for said liquid flow valve, said switching member being embodied as an electrical conductor which is provided on the outer surface of said filling tube and is electrically insulated relative to said filling tube and said filling element body, said switching member extending as far as into said pressurized gas chamber, said filling element further including parts arranged in interior of said annular pressurized gas chamber for providing electrical connection for said switching member.

12. A filling element according to claim 11, in which said parts for providing electrical connection for said switching member includes a contact pin which is electrically insulated relative to said filling element body, said contact pin extending essentially radially through said annular pressurized gas chamber and being resiliently pressed against said switching member at said filling tube.

* * * * *